US009903092B2

(12) United States Patent
Lunn et al.

(10) Patent No.: US 9,903,092 B2
(45) Date of Patent: Feb. 27, 2018

(54) EXCAVATION BUCKET

(71) Applicants: Jason Lunn, Lambton (AU); Reece Attwood, Mayfield West (AU); Glenn Baxter, Duncraig (AU)

(72) Inventors: Jason Lunn, Lambton (AU); Reece Attwood, Mayfield West (AU); Glenn Baxter, Duncraig (AU)

(73) Assignee: Bradken Resources Pty Limited, Mayfield West, NSW (AU)

( * ) Notice: Subject to any disclaimer, the term of this patent is extended or adjusted under 35 U.S.C. 154(b) by 8 days.

(21) Appl. No.: 14/347,592

(22) PCT Filed: Sep. 26, 2012

(86) PCT No.: PCT/AU2012/001158

§ 371 (c)(1),
(2) Date: Mar. 26, 2014

(87) PCT Pub. No.: WO2013/044297

PCT Pub. Date: Apr. 4, 2013

(65) Prior Publication Data

US 2014/0230293 A1 Aug. 21, 2014

(30) Foreign Application Priority Data

Sep. 26, 2011 (AU) ..... 2011903970

(51) Int. Cl.
*E02F 3/40* (2006.01)
*E02F 9/28* (2006.01)

(52) U.S. Cl.
CPC ..... *E02F 3/40* (2013.01); *E02F 9/2808* (2013.01); *E02F 9/2883* (2013.01)

(58) Field of Classification Search
CPC ..... E02F 3/40; E02F 3/141
See application file for complete search history.

(56) References Cited

U.S. PATENT DOCUMENTS 1,107,252 A * 8/1914 Black ..... E02F 3/40 37/444
1,872,866 A 8/1932 Young
2,336,729 A * 12/1943 Harris ..... E02F 3/40 228/182
2,427,897 A * 9/1947 Burdick ..... E02F 3/40 37/444
2,584,416 A * 2/1952 Boehringer ..... E02F 3/40 37/444

(Continued)

OTHER PUBLICATIONS

International Search Report dated Dec. 21, 2012, directed to International PCT/AU2012/110058, 6 pgs.

*Primary Examiner* — Matthew D. Troutman
(74) *Attorney, Agent, or Firm* — Morrison & Foerster LLP

(57) ABSTRACT

A member for assembly with other members in an assembled condition to form an excavation bucket, the member forming at least part of one of the walls of the bucket when in its assembled condition, the member comprising a body having a forward edge; a rearward edge; opposite inner and outer surfaces that extend between the edges; a first portion of the member being thicker between its inner and outer surfaces than a second portion of the member, the first portion being disposed forward of the second portion.

15 Claims, 28 Drawing Sheets

(56) References Cited

U.S. PATENT DOCUMENTS 2,724,518 A * 11/1955 Charlton ..... E02F 3/40 37/444
2,788,907 A * 4/1957 Larsen ..... E02F 3/40 37/444
2,911,120 A * 11/1959 Brown ..... E02F 3/40 37/444
2,926,800 A * 3/1960 Larsen ..... E02F 3/40 219/137 R
3,107,445 A 10/1963 Ratkowski
3,896,569 A 7/1975 Thompson et al.
3,984,928 A 10/1976 Oke et al.
4,007,550 A * 2/1977 Stepe ..... E02F 3/40 172/701.2
D246,176 S * 10/1977 Dahlberg ..... D15/32
D249,088 S * 8/1978 Dahlberg ..... D15/32
4,290,214 A * 9/1981 Stepe ..... E02F 9/2808 172/701.2
4,776,113 A * 10/1988 Bedford ..... E02F 9/2825 172/701.2
5,063,694 A * 11/1991 McCreary, Jr. ..... E02F 3/40 37/443
6,834,449 B2 * 12/2004 Leslie ..... E02F 3/60 37/398
7,266,914 B2 * 9/2007 Grant ..... E02F 3/40 37/444
7,774,959 B2 * 8/2010 Kubo ..... E02F 3/60 299/18
D631,490 S * 1/2011 Drager ..... D15/32
8,572,870 B2 * 11/2013 Kudo ..... E02F 3/60 37/444
2005/0172524 A1 * 8/2005 Grant ..... E02F 3/40 37/446
2005/0241194 A1 * 11/2005 Bierwith ..... E02F 9/2816 37/455
2005/0284006 A1 * 12/2005 Jones ..... E02F 3/8152 37/446
2007/0051022 A1 * 3/2007 Meyers ..... E02F 9/2825 37/455
2008/0028643 A1 * 2/2008 Osgood ..... E01H 5/066 37/241
2009/0183397 A1 * 7/2009 Kubo ..... E02F 3/60 37/399
2010/0005689 A1 * 1/2010 Leslie ..... E02F 3/60 37/444
2010/0269378 A1 * 10/2010 Kubo ..... E02F 3/60 37/399
2013/0192101 A1 * 8/2013 Gilmore ..... E02F 9/006 37/445

* cited by examiner

EXCAVATION BUCKET

CROSS-REFERENCE TO RELATED APPLICATIONS

This application is a continuation of International Application No. PCT/AU2012/001158, filed Sep. 26, 2012, which claims the priority of Australian Application No. 2011903970, filed Sep. 26, 2011, the entire contents of which are incorporated herein by reference.

FIELD OF THE INVENTION

This disclosure relates to excavation buckets for use with digging equipment. The disclosure also relates to parts assembled together to form an excavation bucket including the lip of the bucket.

BACKGROUND OF THE INVENTION

Excavation buckets have long been used in the mining industry for many different types of digging operations. Excavation buckets come in many different sizes and are designed for different purposes. Many buckets, in particular larger buckets, are constructed from separately formed pieces which are then welded together to form the bucket. This is at least partly because it is easier to manufacture the excavation buckets in this way than to create the bucket as a single casting. However, one problem for such excavation buckets is that the weld joins between the assembled pieces are areas of weakness for the bucket and are prone to cracking and failure due to fatigue stress. This is a particular problem for the ground engaging lip of the bucket.

SUMMARY OF THE INVENTION

According to one embodiment, the disclosure provides a member for assembly with other members in an assembled condition to form an excavation bucket, the member forming at least part of one of the walls of the bucket when in its assembled condition, the member comprising a body having: a forward edge; a rearward edge; opposite inner and outer surfaces that extend between the edges; a first portion of the member being thicker between its inner and outer surfaces than a second portion of the member, the first portion being disposed forward of the second portion.

According to another embodiment, the disclosure provides a lip for assembly in an excavation bucket in an assembled condition, the lip comprising: a base portion having a front edge that forms part of a digging edge of the bucket in use and a rear edge for joining to at least one other member of the bucket when the lip is in its assembled condition; and wing members extending from opposed sides of the base portion, each wing member having: a forward edge; a rearward edge; opposite inner and outer surfaces that extend between the edges; a first portion of the member being thicker between its inner and outer surfaces than a second portion of the member, the first portion being disposed forward of the second portion.

According to another embodiment, the disclosure provides an excavation bucket assembly comprising a first member and a second member, each member having a joint edge that are joined to each other when the members are brought into an assembled condition to at least partly form a wall of the excavation bucket, each of the first and second members having a first portion that is thicker between its inner and outer surfaces than a second portion of the member, the first portion being disposed forward of the second portion.

According to another embodiment, the disclosure provides a member of an excavation bucket for assembly with at least one other bucket member in an assembled condition to form the bucket, the member comprising: a body having opposite inner and outer surfaces that respectively define at least portions of inner and outer surfaces of the bucket when the member is in its assembled condition; and a recess formed in at least one of the inner and outer surfaces of the member.

According to another embodiment, the disclosure provides a member of an excavation bucket for assembly with at least one other bucket member in an assembled condition to form the bucket, the member comprising: a body having; opposite inner and outer surfaces that respectively define at least portions of inner and outer surfaces of the bucket when the member is in its assembled condition; a joint edge that in use joins to a corresponding joint edge of another bucket member to form a joint in the excavator bucket; and a weakened region that is arranged to preferentially deform under load so as to relieve loading in the excavator bucket joint.

According to another embodiment, the disclosure provides an excavation bucket assembly incorporating first and second members that are interconnected by a joint in an assembled condition, each member comprising: a body having a joint edge that is joined to the joint edge of the other member when the members are brought into an assembled condition to at least partly form a wall of the excavation bucket, each member's body also having opposite inner and outer surfaces that respectively define at least portions of inner and outer surfaces of the bucket when the members are in their assembled condition; and at least one of the members also comprising: a recess formed in at least one of the inner and outer surfaces of that member.

According to another embodiment, the disclosure provides an excavation bucket assembly incorporating first and second members that are interconnected by a joint in an assembled condition, wherein at least one of the first and second members comprises a weakened region that is arranged to preferentially deflect under load to relieve loading in the joint.

According to another embodiment, the disclosure provides a wear member of a wear assembly for assembly with an excavation bucket in an assembled condition, the wear member having an inner face that engages the excavation bucket when the wear member is in its assembled condition and an opposite outer face, the wear member comprising: a wrapping portion configured to wrap around an edge of the excavation bucket when in he assembled condition; and a leg extending away from the wrapping portion; wherein the inner face of the wear member bulges along a substantial portion of the leg for receipt in a recess of the excavation bucket when the wear member is in its assembled condition.

According to another embodiment, the disclosure provides an excavation bucket assembly comprising: a first bucket member having a forward edge and a rear edge; a second bucket member having a forward edge and a rear edge, the first and second bucket members also each having a joint edge which join to each other when the bucket members are brought into an assembled condition; and a wear member for protecting at least part of the forward edge of at least one of the bucket members, the wear member comprising a wrapping portion configured to cover the part of the forward edge of the bucket member(s) when the wear member is brought into an assembled condition with the bucket members and a leg extending away from the wrapping portion, the leg configured to be received in a recess formed in at least one of the bucket members when the wear member is in its assembled condition with the bucket members.

According to another embodiment, the disclosure provides a member of an excavation bucket for assembly with at least one other bucket member in an assembled condition to form the bucket, the member comprising: a body having opposite inner and outer surfaces that respectively define at least portions of inner and outer surfaces of the bucket when the member is in its assembled condition; and a shear support formation integrally formed with the body for protecting a wear member that is assembled with the member of the excavation bucket against shear forces in use.

According to another embodiment, the disclosure provides an excavation bucket assembly comprising: a bucket member for assembly with at least one other bucket member in an assembled condition to form the bucket, the member comprising a body having a forward edge and a rearward edge and opposite inner and outer surfaces that respectively define at least portions of inner and outer surfaces of the bucket when the member is in its assembled condition; and a wear member for assembly with the bucket member to protect at least part of the forward edge of the bucket member; wherein the bucket member also comprising a shear support formation integrally formed with the bucket member's body for protecting the wear member in its assembled condition with the bucket member against shear forces in use.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION OF THE INVENTION

Figure 1:
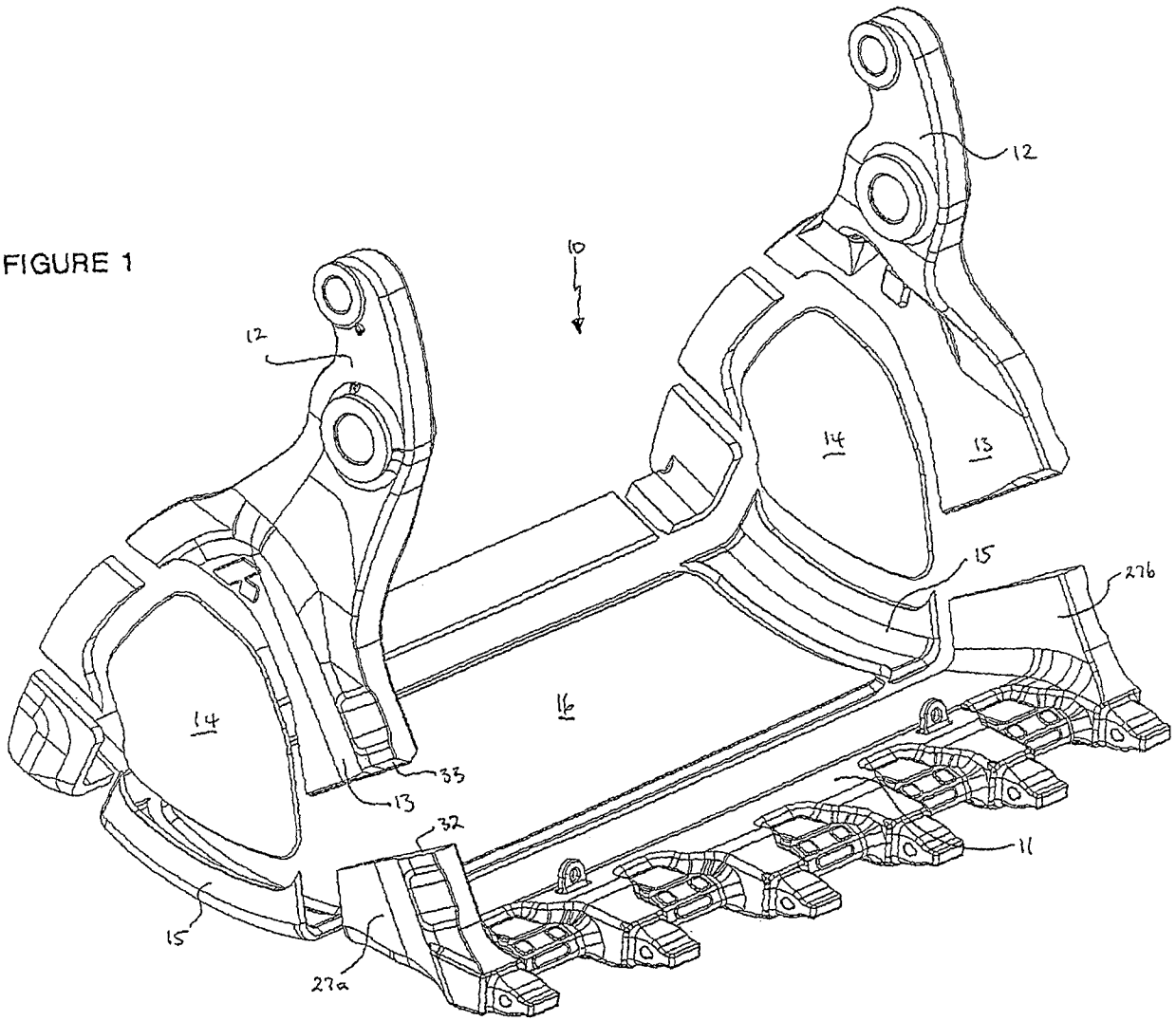
FIG. 1 is an exploded perspective view of an excavation bucket according to an embodiment of the disclosure.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The present disclosure is directed generally to excavation buckets including members such as lips and cheek members that are formed separately and then assembled to form the excavation buckets. The present disclosure is also directed generally to wear members or shrouds used to protect the edges of the side walls of the excavation buckets against wear.

In one embodiment, the present disclosure provides a member for assembly with other members in an assembled condition to form an excavation bucket, the member forming at least part of one of the walls of the bucket when in its assembled condition, the member comprising a body having: a forward edge; a rearward edge; opposite inner and outer surfaces that extend between the edges; a first portion of the member being thicker between its inner and outer surfaces than a second portion of the member, the first portion being disposed forward of the second portion.

The body of the member may also have an intermediate portion that tapers between the inner and outer surfaces of the body from the first portion to the second portion.

The second portion may extend from the intermediate portion to the rearward edge of the body and the first portion may extend from the intermediate portion to the forward edge of the body.

In an embodiment, the member is a cast member.

In an embodiment, the member's body has a joint edge for joining to at least one other member of the bucket in the member's assembled condition, the joint edge extending between the rearward and forward edges, preferably substantially linearly although may be curved or have a complex shape in extension.

In another embodiment, the present disclosure also provides a member of an excavation bucket for assembly with at least one other bucket member in an assembled condition to form the bucket, the member comprising: a body having opposite inner and outer surfaces that respectively define at least portions of inner and outer surfaces of the bucket when the member is in its assembled condition; and a recess formed in at least one of the inner and outer surfaces of the member.

In an embodiment, the body of the member has a joint edge for engaging and joining to the at least one other bucket member in the assembled condition to form the bucket, the joint edge extending between the inner and outer surfaces of the body.

In an embodiment, the recess is elongated in a direction substantially parallel to the joint edge of the member. The recess may also be spaced from the joint edge of the member.

In an embodiment, the recess is formed in the outer surface of the member's body, but in other embodiments may be formed in the inner surface of the member's body.

In an embodiment, the body of the member has a forward edge and a rearward edge, the recess extending away from the forward edge.

In an embodiment, the body has a first portion that is thicker between its inner and outer surfaces than a second portion and the recess is formed in the first portion. In an embodiment, the recess extends across the width of the thicker first portion.

In an embodiment, the member also comprises a mounting formation for a wear member that in use protects the member against wear to be mounted to, the mounting formation located in the recess.

In an embodiment, the mounting formation does not extend beyond the surface of the member's body in which the recess is formed.

In an embodiment, the mounting formation comprises a boss extending from the floor of the recess. Preferably, the boss widens as it extends from the floor of the recess.

In another embodiment, the present disclosure provides a member of an excavation bucket for assembly with at least one other bucket member in an assembled condition to form the bucket, the member comprising: a body having; opposite inner and outer surfaces that respectively define at least portions of inner and outer surfaces of the bucket when the member is in its assembled condition; a joint edge that in use joins to a corresponding joint edge of another bucket member to form a joint in the excavator bucket; and a weakened region that is arranged to preferentially deform under load so as to relieve loading in the excavator bucket joint.

In an embodiment, the weakened region comprises a recess formed in the inner and/or outer surface of the member's body.

In an embodiment, the member is a side wall portion of the excavation bucket when in its assembled condition.

In an embodiment, the member is a wing member of a lip for the excavation bucket, the lip comprising a base portion that forms part of the digging edge of the bucket and wherein the wing member extends from the base portion at a side of the base portion.

In another embodiment, the present disclosure provides excavation bucket assembly comprising a first member and a second member, each member having a joint edge that are joined to each other when the members are brought into an assembled condition to at least partly form a wall of the excavation bucket, each of the first and second members having a first portion that is thicker between its inner and outer surfaces than a second portion of the member, the first portion being disposed forward of the second portion.

In an embodiment, the first and second members have correspondingly shaped surfaces for engagement with each other.

In an embodiment, the joint edges of the first and second members have substantially identical shapes in section.

In an embodiment, the joint edge of one of the members has a ridge extending along the length of the edge and the other member has a corresponding groove extending along the length of its joint edge.

In an embodiment, each of the first and second members has a forward edge that defines an outer edge of the bucket when the members are in their assembled condition and a opposite rearward edge that joins to at least one further member of the bucket when the members are in their assembled condition. The thicker first portion of each of the first and second members extends from their respective forward edges. Further, each of the first and second members have an intermediate portion that tapers from their respective thicker first portion to their respective second portion.

According to another embodiment, the present disclosure provides an excavation bucket assembly incorporating first and second members that are interconnected by a joint in an assembled condition, each member comprising: a body having a joint edge that is joined to the joint edge of the other member when the members are brought into an assembled condition to at least partly form a wall of the excavation bucket, each member's body also having opposite inner and outer surfaces that respectively define at least portions of inner and outer surfaces of the bucket when the members are in their assembled condition; and at least one of the members also comprising: a recess formed in at least one of the inner and outer surfaces of that member.

In an embodiment, both the first and second members comprise a recess in at least one of their inner and outer surfaces.

In an embodiment, the recess in the first member and the recess in the second member are elongate in a direction substantially parallel to each other when the members are in their assembled condition.

In an embodiment, the recess in the first member is substantially identical in shape to the recess in the second member.

In another embodiment, the present disclosure provides an excavation bucket assembly incorporating first and second members that are interconnected by a joint in an assembled condition, wherein at least one of the first and second members comprises a weakened region that is arranged to preferentially deflect under load to relieve loading in the joint.

In an embodiment, the each of the first and second members comprise said weakened region.

In an embodiment, the weakened regions are disposed either side of the joint.

In an embodiment, the weakened region comprises a recess.

In an embodiment, the first member is a wing member of a lip for the excavation bucket, the lip comprising a base portion that forms the digging edge of the bucket when the lip is in an assembled condition with the other members to form the bucket and wherein the wing member extends from the base portion at a side of the base portion and the second member is a side wall member that forms at least part of the side wall of the bucket when in its assembled condition.

In another embodiment, the present disclosure provides a wear member of a wear assembly for assembly with an excavation bucket in an assembled condition, the wear member having an inner that engages the excavation bucket when the wear member is in its assembled condition and an opposite outer face, the wear member comprising: a wrapping portion configured to wrap around an edge of the excavation bucket when in he assembled condition; and a leg extending away from the wrapping portion; wherein the inner face of the wear member bulges along a substantial portion of the leg for receipt in a recess of the excavation bucket when the wear member is in its assembled condition.

In an embodiment, the wrapping portion is wider than the leg.

In an embodiment, the wear member comprises an engaging portion for engaging a mounting formation on the excavation bucket to bring the wear member into its assembled condition with the bucket. In an embodiment, the engaging portion is formed in the leg of the wear member.

In an embodiment, the engaging portion comprises a slot formed in the inner face of the wear member where it bulges.

In an embodiment, the slot opens in a distal end of the leg from the wrapping portion.

In another embodiment, the present disclosure provides a wear assembly for assembly with an excavation bucket in an assembled condition, the wear member comprising: a wear member as described in any of the embodiments above; and a lock for locking the wear member in its assembled condition with the excavation bucket.

In another embodiment, the present disclosure provides an excavation bucket assembly comprising: a first bucket member having a forward edge and a rear edge; a second bucket member having a forward edge and a rear edge, the first and second bucket members also each having a joint edge which join to each other when the bucket members are brought into an assembled condition; and a wear member for protecting at least part of the forward edge of at least one of the bucket members, the wear member comprising a wrapping portion configured to cover the part of the forward edge of the bucket member(s) when the wear member is brought into an assembled condition with the bucket members and a leg extending away from the wrapping portion, the leg configured to be received in a recess formed in at least one of the bucket members when the wear member is in its assembled condition with the bucket members.

In an embodiment, the recess is formed in an outer surface of one of the bucket members.

In an embodiment, the wrapping portion of the wear member when the wear member is in its assembled condition covers the join between the joint edges of the bucket members at the bucket members' forward edge.

According to another embodiment, the disclosure provides a member of an excavation bucket for assembly with at least one other bucket member in an assembled condition to form the bucket, the member comprising: a body having opposite inner and outer surfaces that respectively define at least portions of inner and outer surfaces of the bucket when the member is in its assembled condition; and a shear support formation integrally formed with the body for protecting a wear member that is assembled with the member of the excavation bucket against shear forces in use.

The shear support formation may be formed on the outer surface of the body and in one form comprises a recess in the body.

According to another embodiment, the disclosure provides an excavation bucket assembly comprising: a bucket member for assembly with at least one other bucket member in an assembled condition to form the bucket, the member comprising a body having a forward edge and a rearward edge and opposite inner and outer surfaces that respectively define at least portions of inner and outer surfaces of the bucket when the member is in its assembled condition; and a wear member for assembly with the bucket member to protect at least part of the forward edge of the bucket member; wherein the bucket member also comprising a shear support formation integrally formed with the bucket member's body for protecting the wear member in its assembled condition with the bucket member against shear forces in use.

The shear support formation may comprise a recess that is shaped to receive therein a portion of the wear member.

Figure 2:
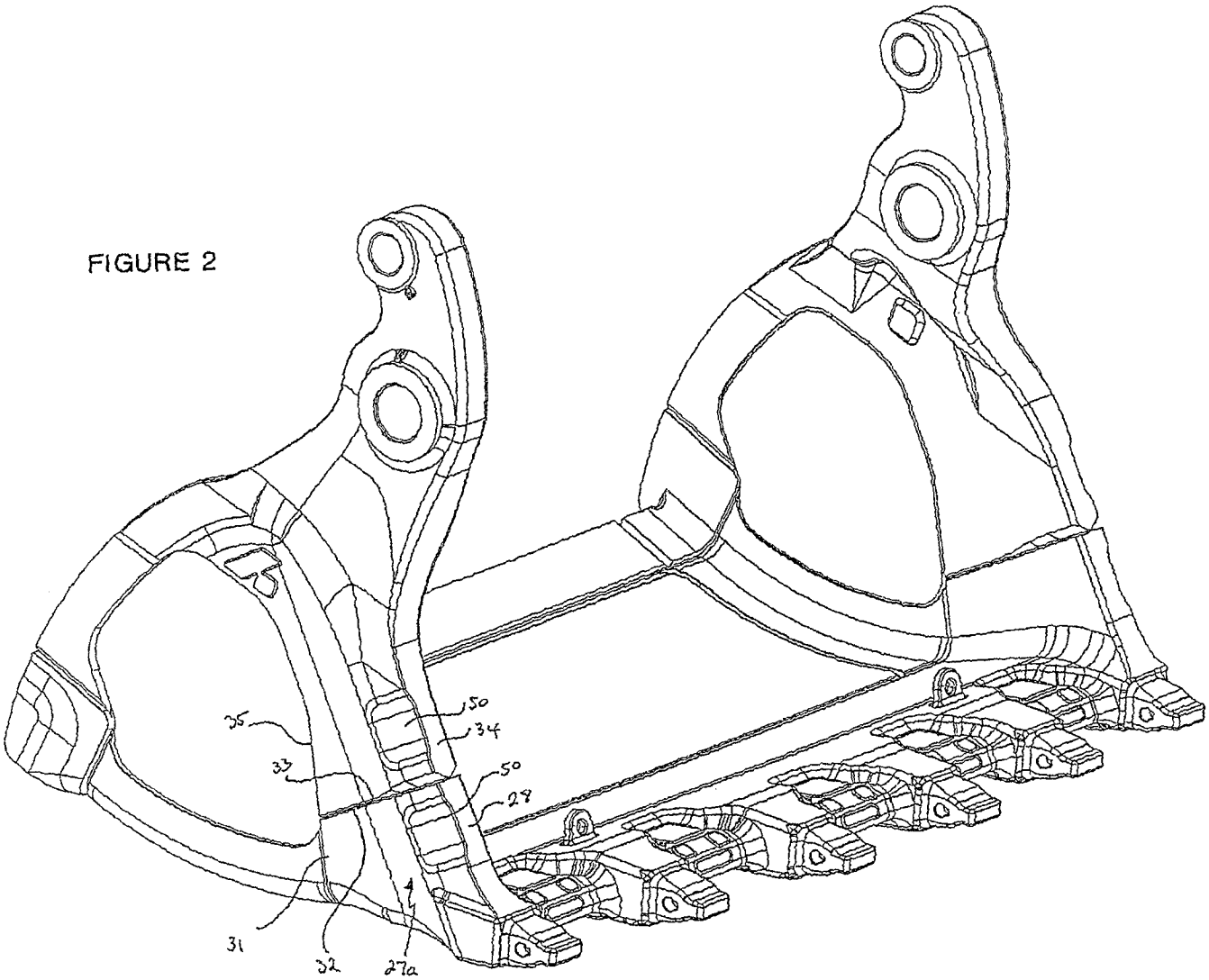
FIG. 2 is a perspective view of the excavation bucket of FIG. 1 with its parts in an assembled condition.
Figure 3:
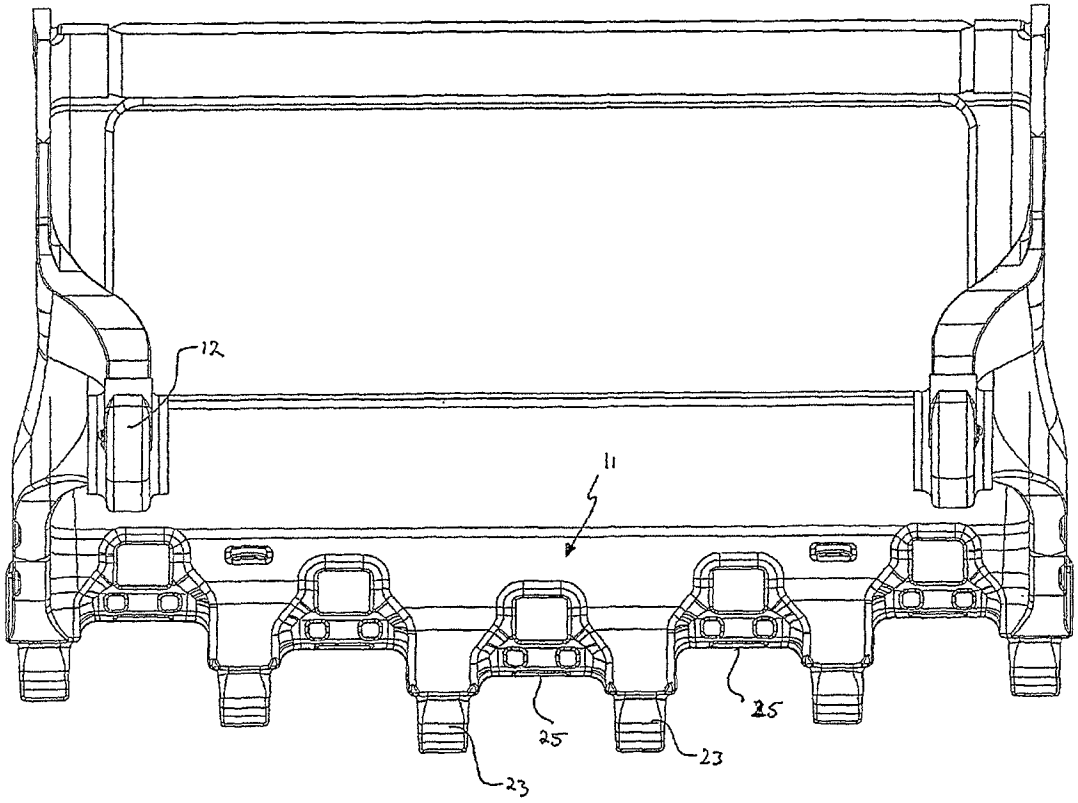
FIGS. 3-6 are top, rear, front and side views of the assembled excavation bucket of FIG. 1.
Figure 4:
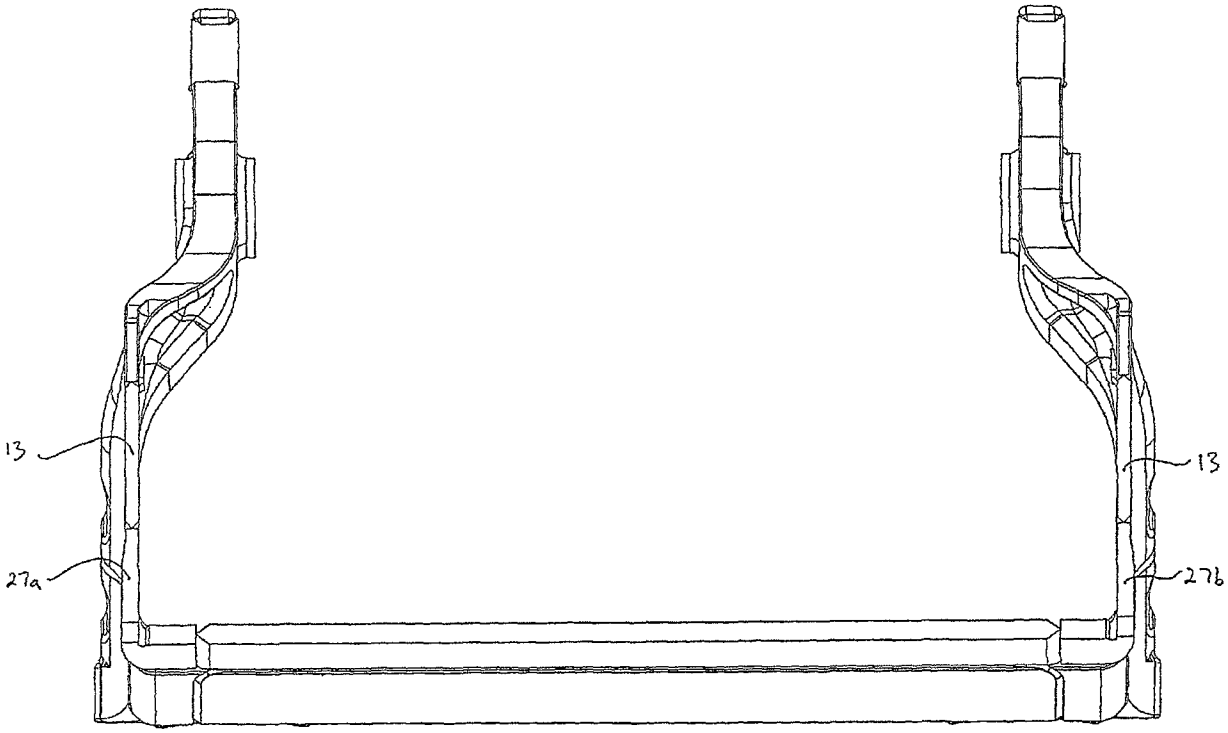
Figure 5:
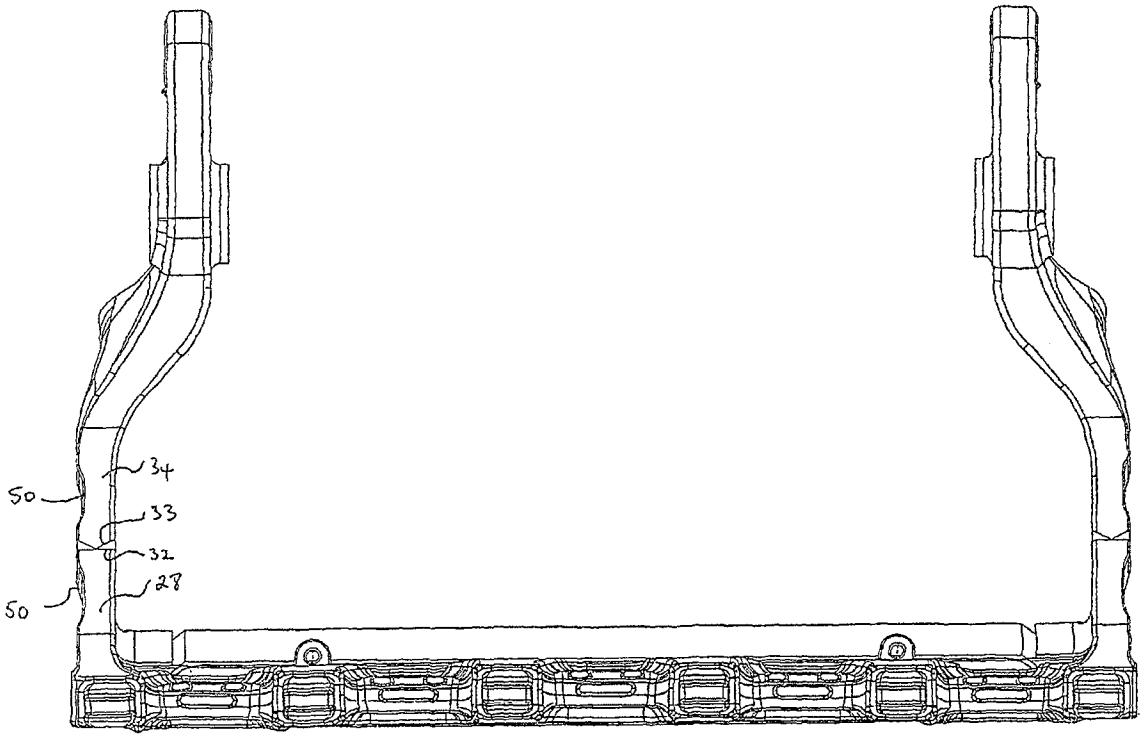
Figure 6:
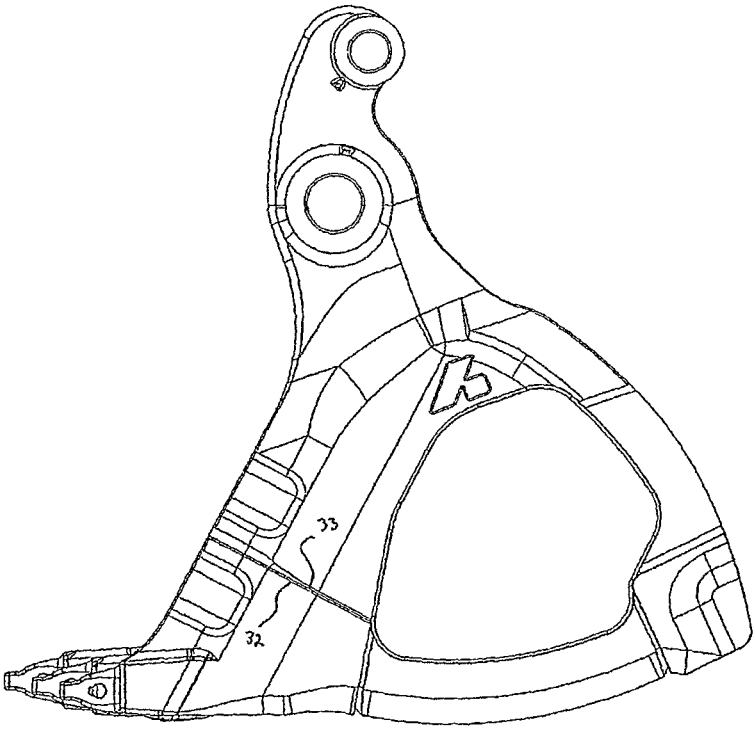
Figure 7:
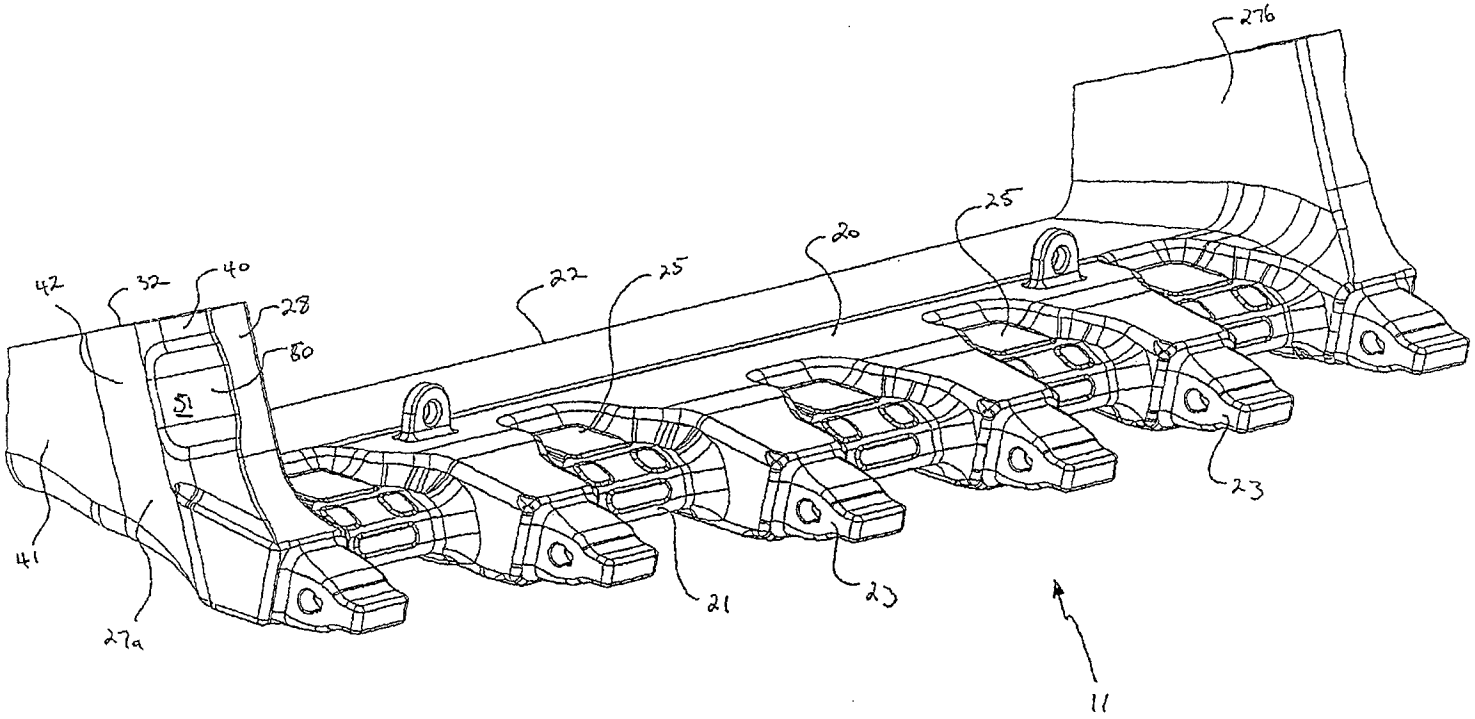
FIG. 7 is a perspective view of the lip of the excavation bucket of FIG. 1 in isolation.

Referring to Figures, some illustrative embodiments of an excavation bucket 10 are shown. As shown in FIGS. 1 and 2, the excavation bucket 10 is assembled from a plurality of parts that are separately formed and then joined together, typically by welding, to assemble the bucket 10. The parts include:

- a lip 11 that provides the ground engaging edge of the bucket;
- two integrally cast hinge necks 12 and cheek members 13, although in an alternative embodiment to that shown in the Figures, these may be formed as separate parts;
- side wall members 14;
- corner members 15;
- a floor member 16; and
- a roof member (not shown).

Figure 16:
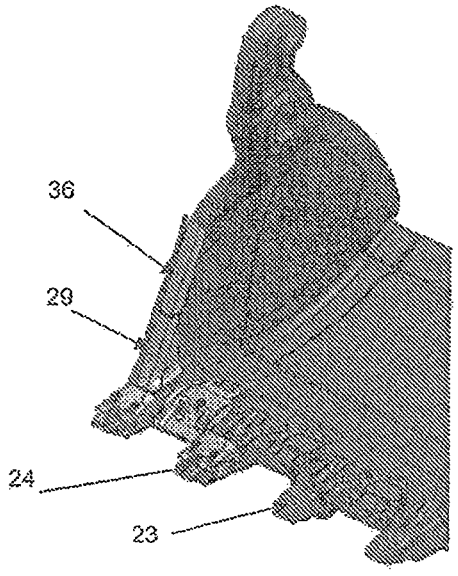
FIGS. 16 and 17 are perspective views of the excavation bucket of FIG. 1 with the wear members of FIG. 15 assembled with the excavation bucket and with further wear members assembled with the lip of the bucket to protect the lip from wear during use.
Figure 17:
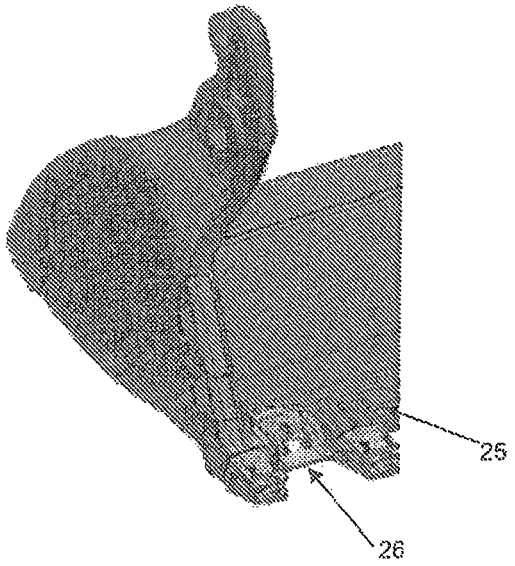
Figure 18:
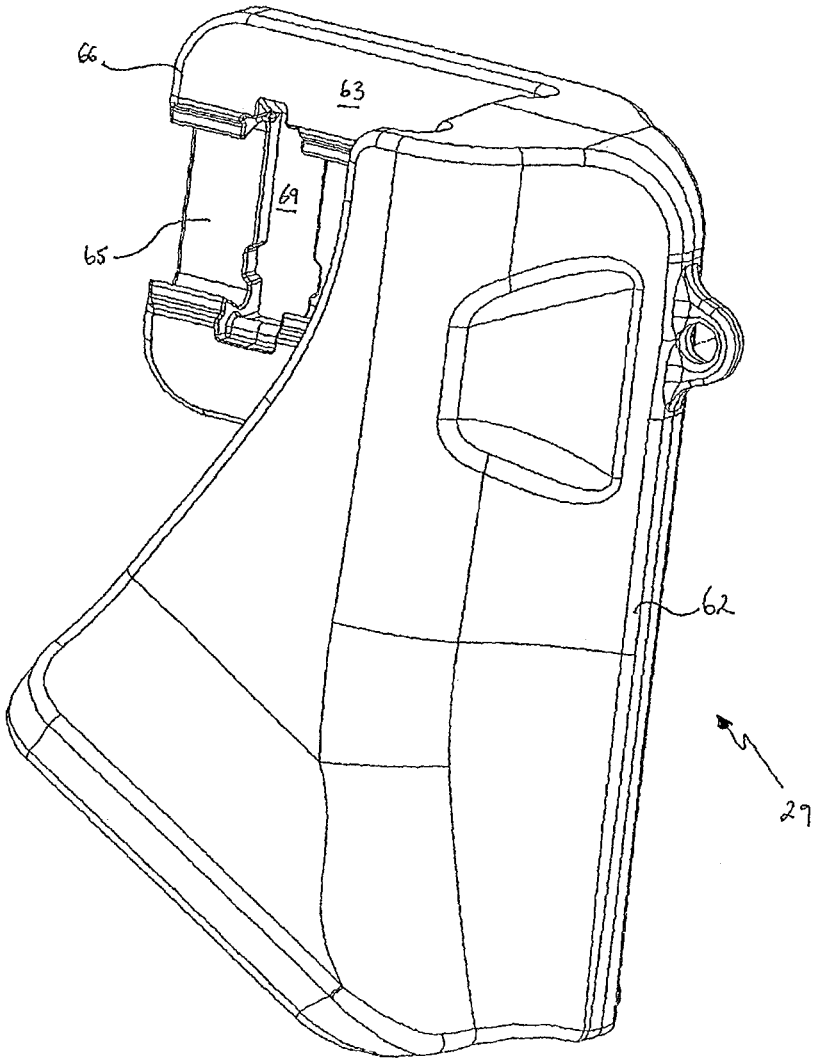
FIG. 18 is a perspective view of the lower of the wear members of FIG. 15 for protecting the side wall edges of the bucket in isolation.
Figure 19:
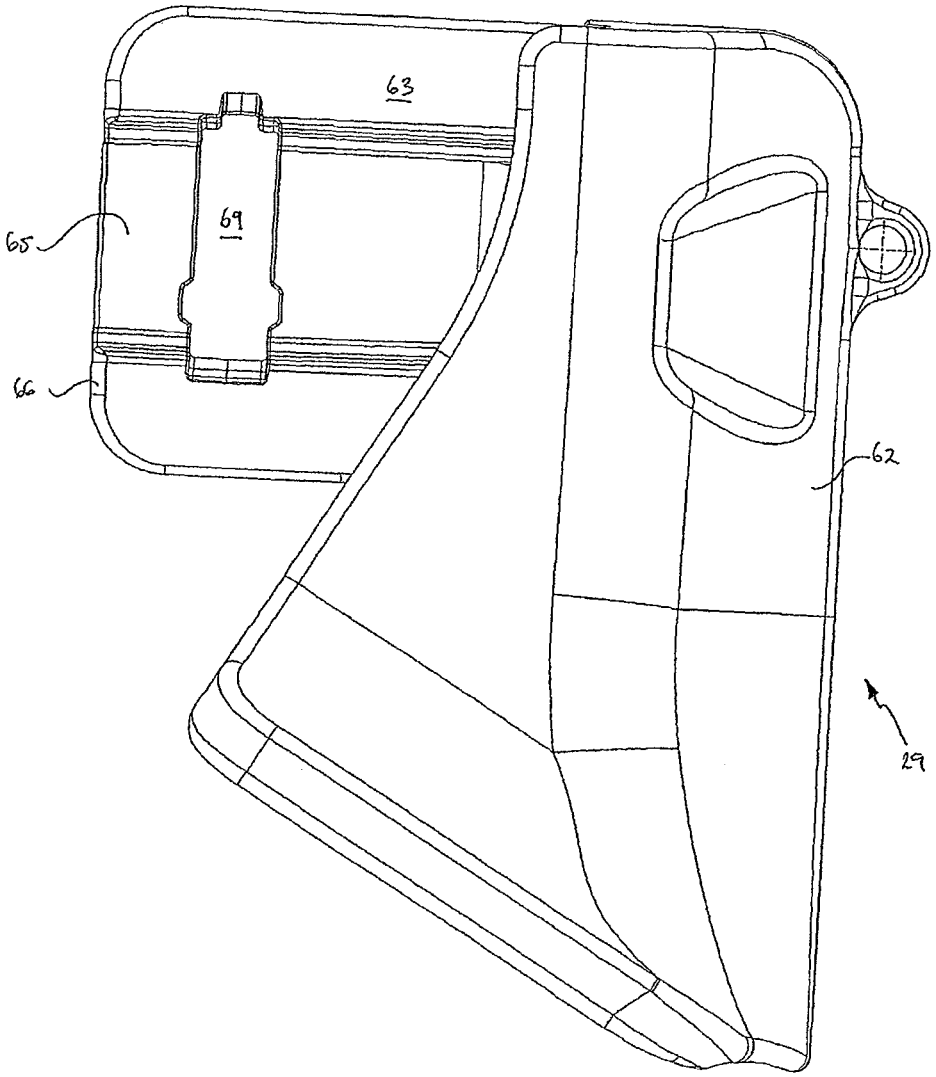
FIGS. 19 and 20 are opposite side views of the wear member of FIG. 18.
Figure 20:
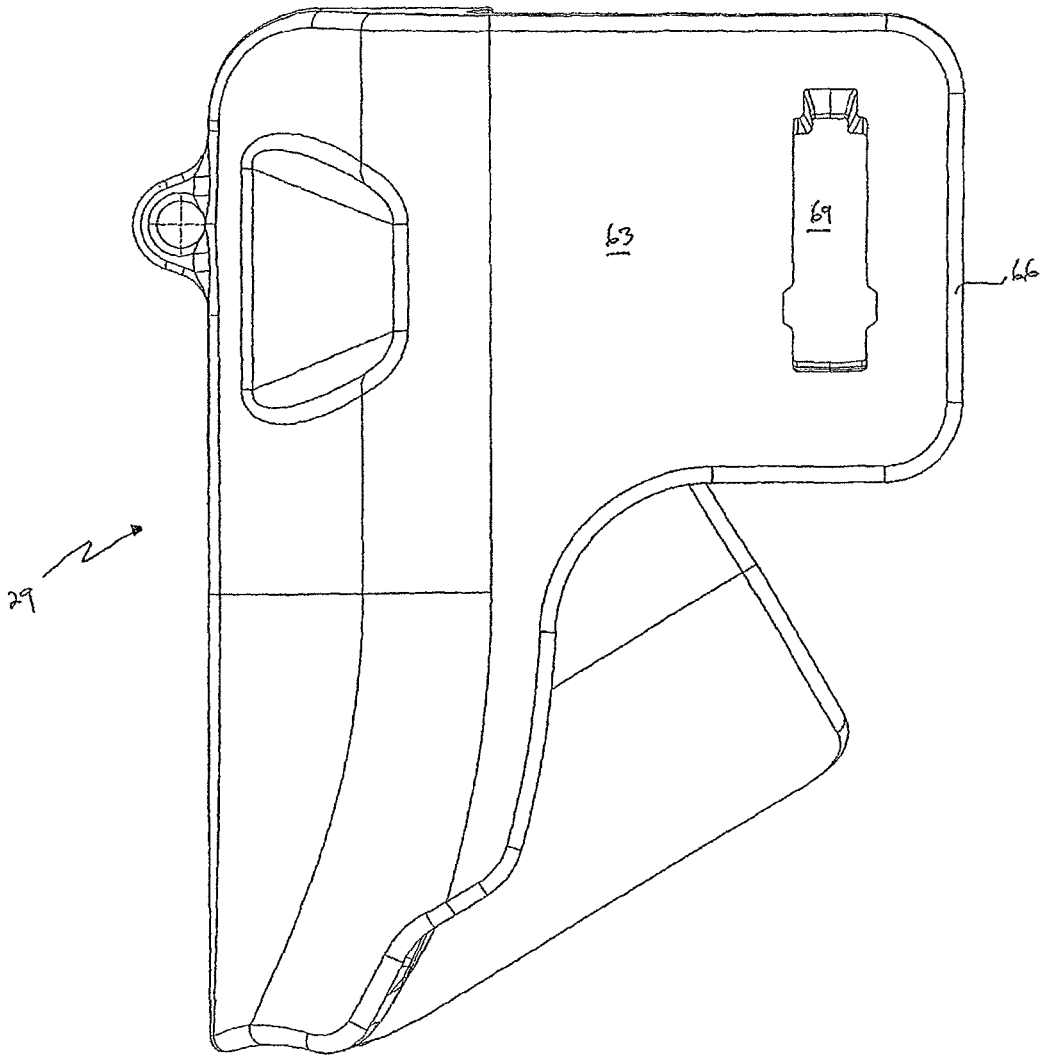
Figure 21:
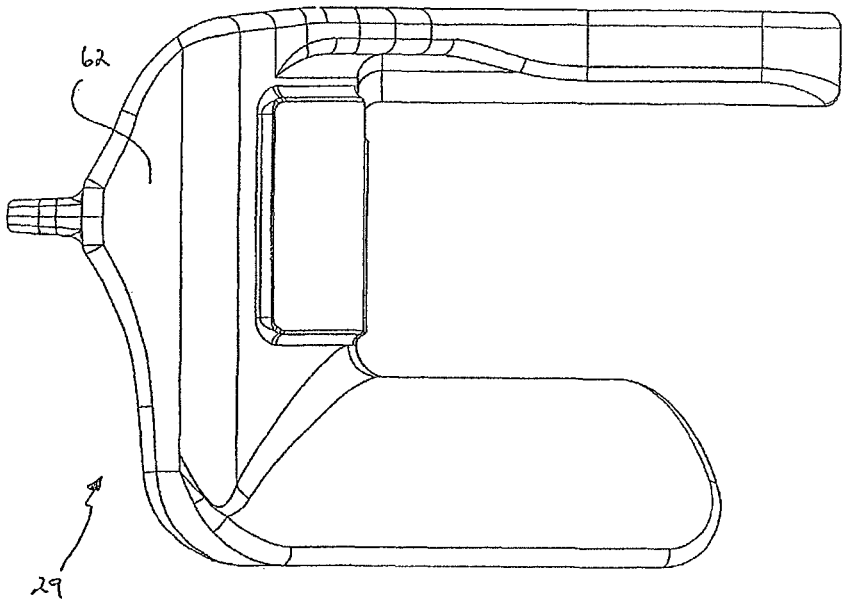
FIGS. 21-23 are top, front and rear views of the wear member of FIG. 18.
Figure 22:
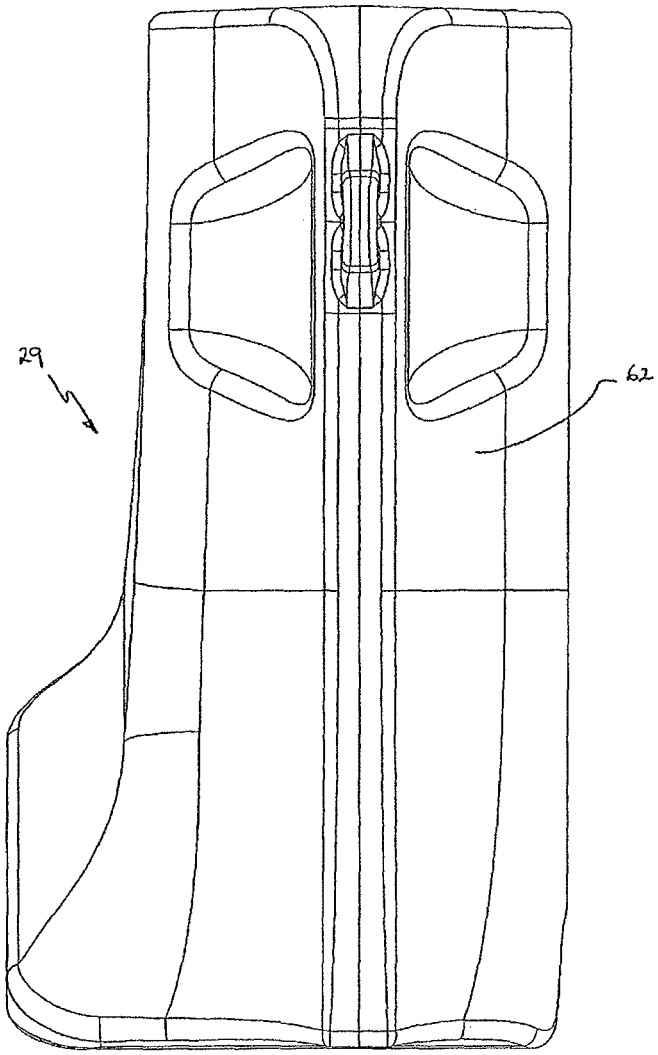
Figure 23:
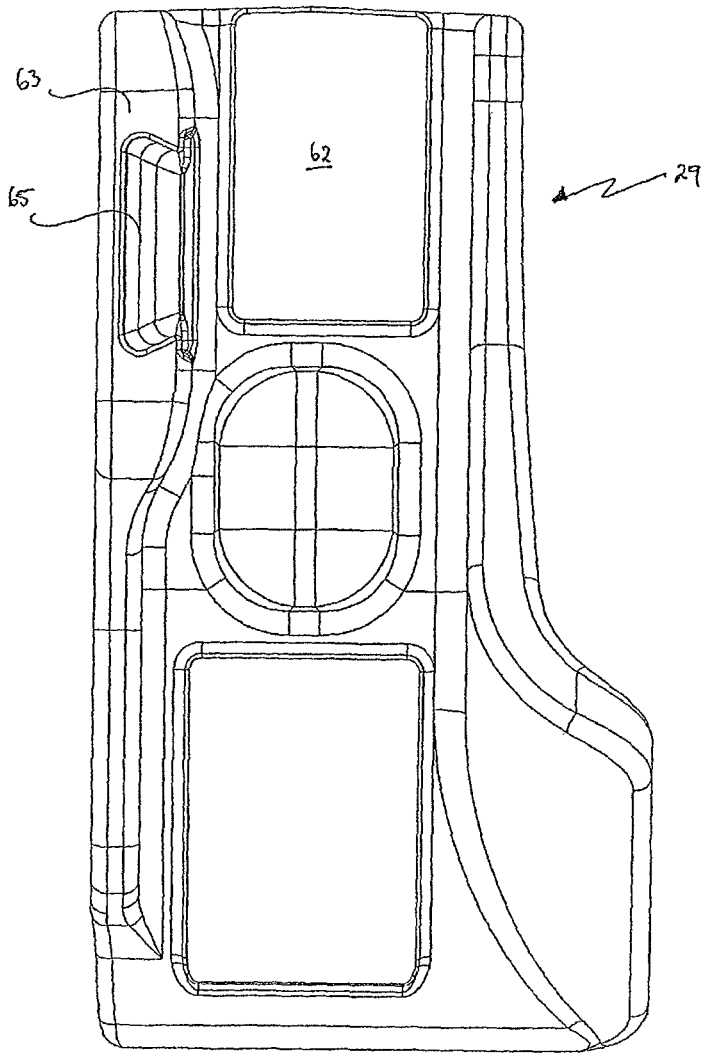
Figure 24:
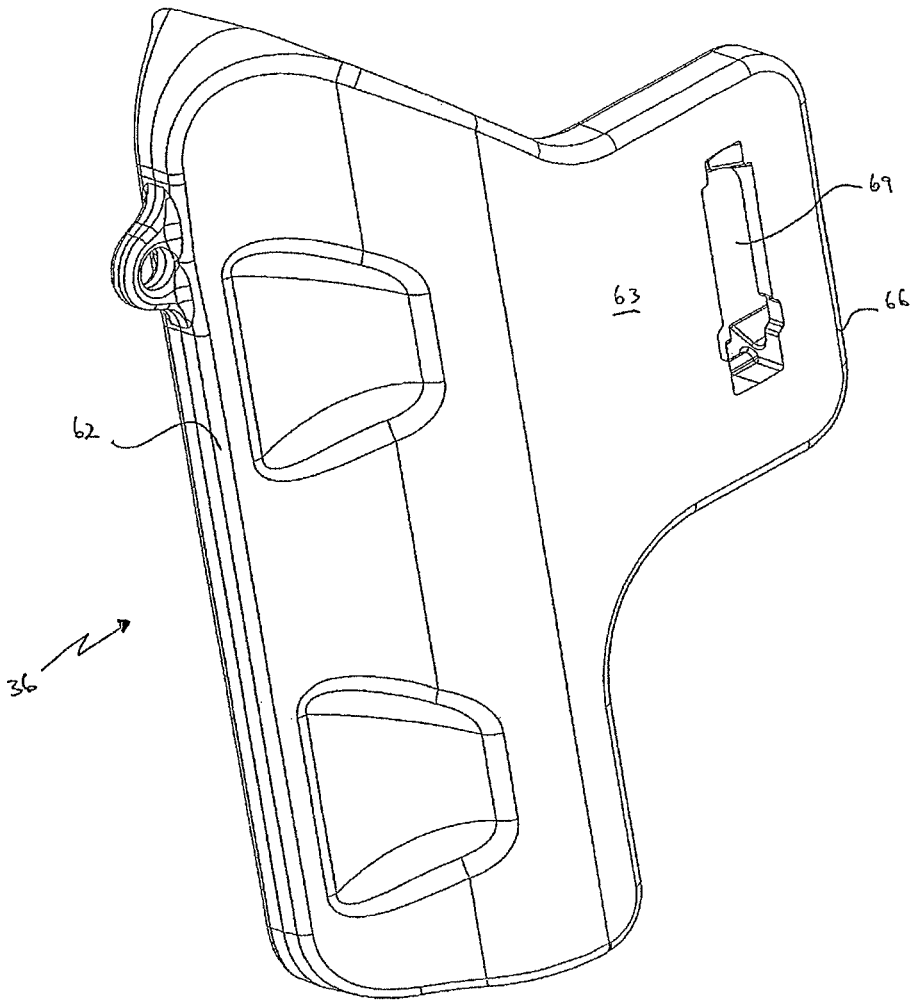
FIG. 24 is a perspective view of the upper of the wear members of FIG. 15 for protecting the side wall edges of the bucket in isolation.
Figure 25:
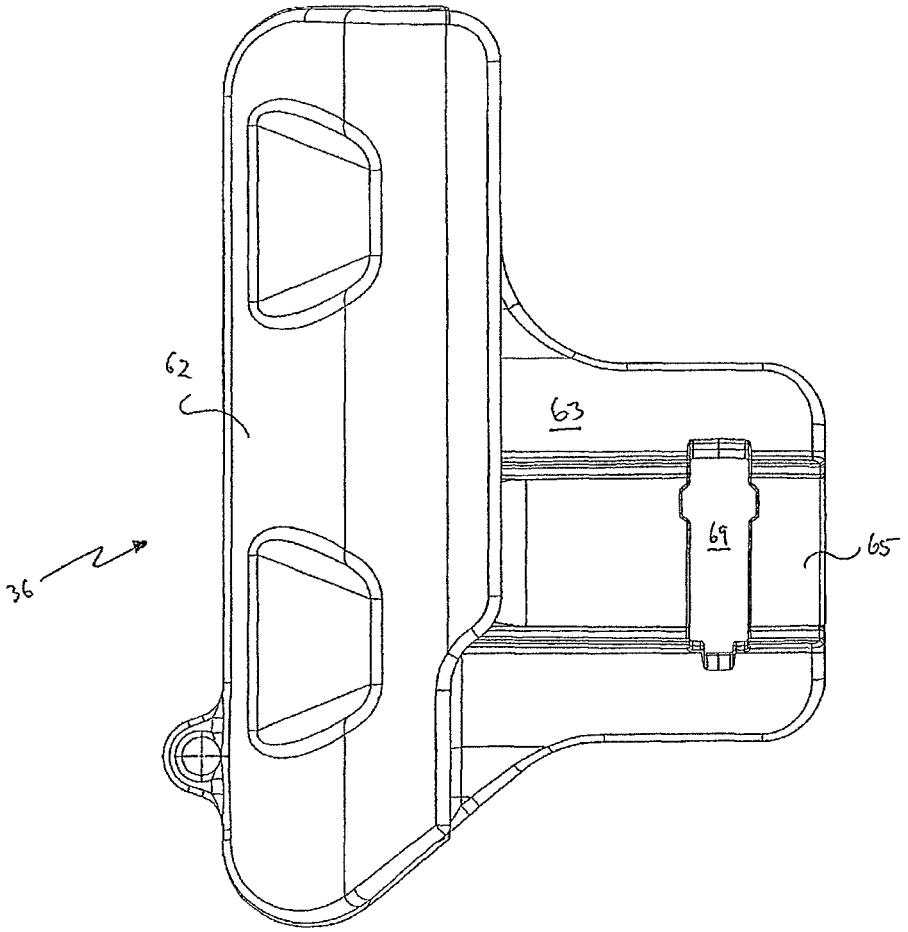
FIGS. 25 and 26 are opposite side views of the wear member of FIG. 24.
Figure 26:
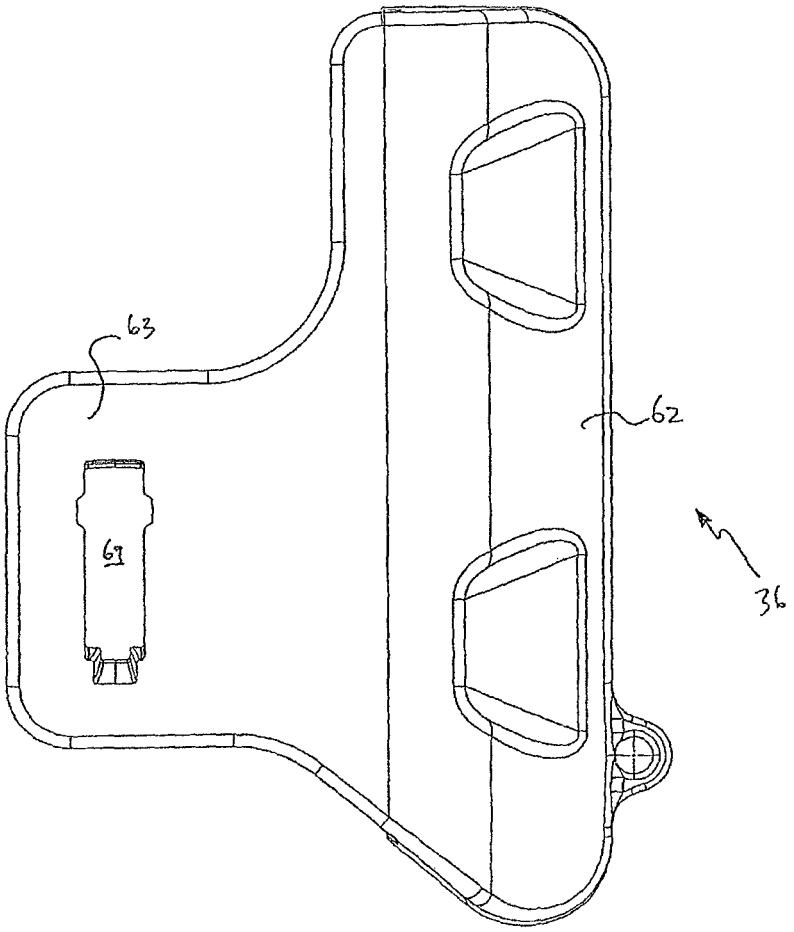
Figure 27:
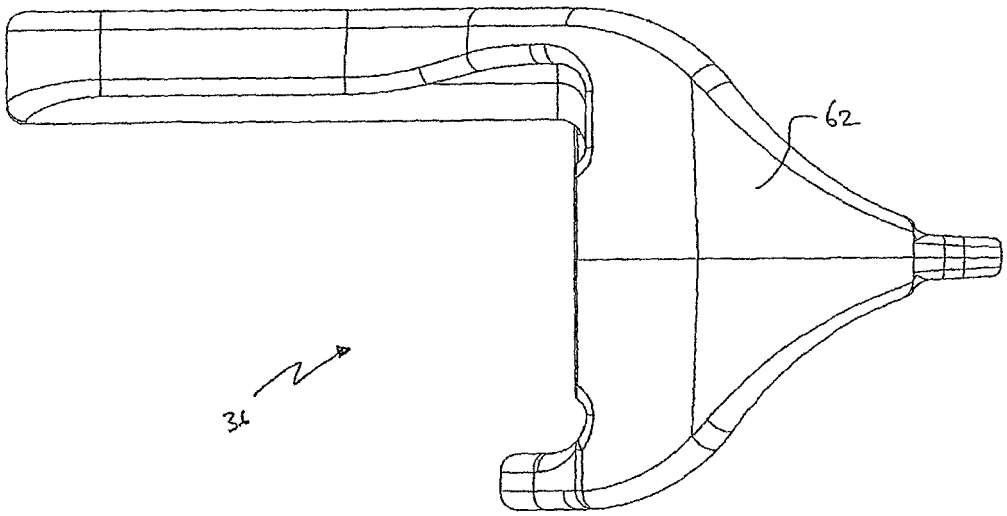
FIGS. 27-29 are top, front and rear views of the wear member of FIG. 24.
Figure 28:
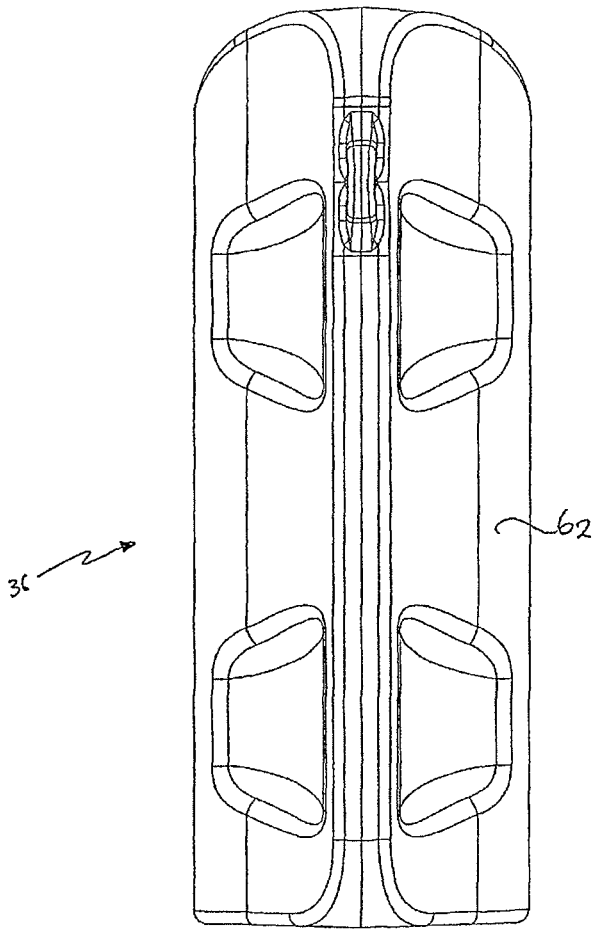
Figure 29:
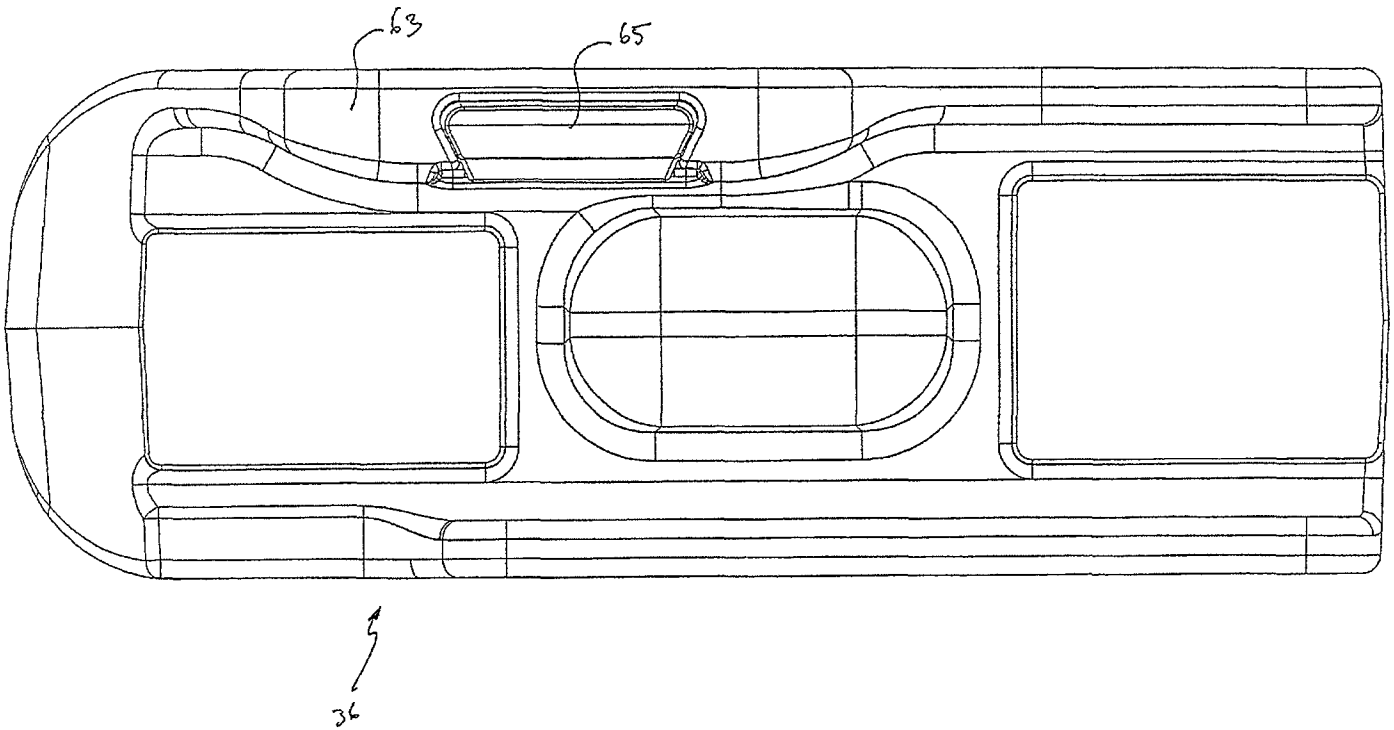

The lip 11 comprises a base portion 20 that extends across the width of the bucket and has a front edge 21 that forms part of the front digging edge of the bucket 10 and an opposite rear edge 22 that is joined to the floor member 16 and corner member 15. Spaced along the front edge 21 of the lip 11 are a plurality of noses 23 to which replaceable tooth assemblies may be mounted. Adaptors 24 of such tooth assemblies are shown for example in FIGS. 16 and 17. The tooth assemblies also comprise points attached to these adaptors, although they are not shown in the Figures. Between each of the noses 23, the front edge 21 of the lip 11 has recesses 25 to which replaceable wear members or 'shrouds' 26 are assembled to provide protection for the front edge of the lip 11 against wear (see FIGS. 16 and 17).

It is to be appreciated that although in the particular embodiment shown in the Figures the lip has six noses and five recesses, that the lip may have more or less such noses or recesses. The lip in the embodiment shown in the Figures is configured such that the noses projecting from the front edge of the lip are in a staggered formation with the central noses projecting further forward than the side noses and the recesses are correspondingly staggered but with the edge of the lip in each of the recesses remaining parallel to each other. This may be referred to in the art as a "semi-spade" arrangement. However, it is to be understood that any other suitable configuration of the noses and recesses may be incorporated into the lip.

Figure 15:
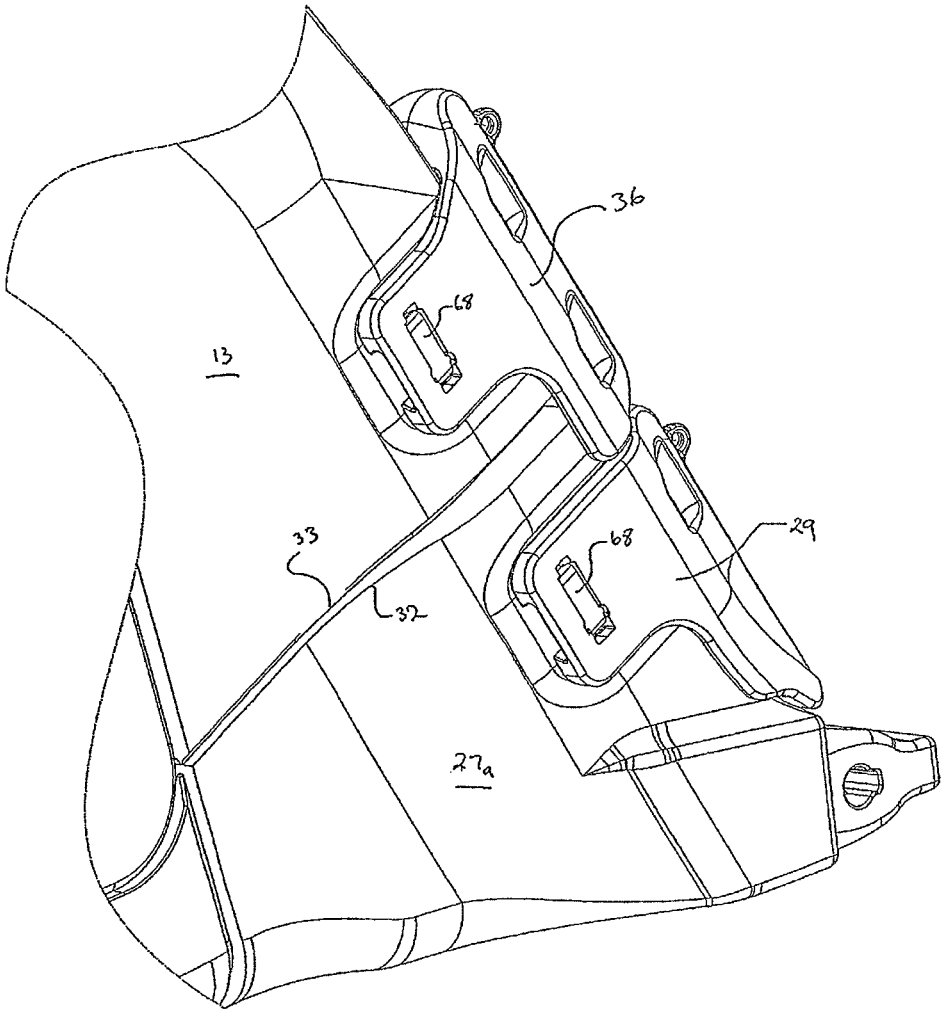
FIG. 15 is a rear perspective view of part of the excavation bucket showing wear members assembled with side walls of the bucket to protect the edges of the side walls from wear during use.

The lip 11 also comprises wing members 27*a* and 27*b* which are located at opposed sides of the body 20 of the lip. When the lip 11 is assembled with the other members to form the excavation bucket 10, the wing members 27*a,b* form part of respective side walls of the bucket, with inner and outer surfaces of the wing members forming part of the inner and outer surfaces of the bucket. The wing members 27*a,b* each project upwardly from the body 20 and extend generally between the front and rear edges 21, 22 of the body 20. The wing members 27*a, b* themselves each have a forward edge 28 which extends upwardly from the front edge 21 of the lip 11 and will, in use, have a digging function. As a result, the forward edge 28 of each of the wing members 27*a,b* will be subject to wear and are accordingly provided with a wear member 29 to protect against this as shown in FIG. 15. The wing members 27*a, b* also each have a rearward edge 31 that faces in the opposite direction to the forward facing edge 28 and is joined to respective corner members 15 and side wall members 14 when the excavation bucket 10 is assembled.

Each wing member 27*a, b* also has a top joint edge 32 that extends between its respective forward and rearward facing edges 28, 31. The top joint edge 32 also angles downwardly towards the body 20 of the lip as the top joint edge 32 extends from the forward to the rearward facing edges 28, 31 of that wing member 27*a,b*. One of the cheek members 13 that is integrally cast with one of the hinge necks 12 joins to the top joint edge 32 of each respective wing member 27*a, b* via a bottom joint edge 33 of the cheek member. The cheek members 13 and hinge necks 12 thus also provide part of respective side walls of the excavation bucket 10, with inner and outer surfaces of the cheek members 13 and hinge necks 12 forming part of the inner and outer surfaces of the bucket. The joint edge 33 of each cheek member 13 extends between forward and rearward edges 34, 35 of the cheek member. When the cheek members 13 are joined to their respective wing members 27*a, b* their forward edges 28, 34 are aligned so that they provide generally continuous forward facing side edges for the bucket 10. As shown in FIG. 15, a wear member 36 is also provided to protect the forward edge 34 of respective cheek members 13 against wear.

The joints between the joint edges 32, 33 of the lip wing members and the cheek members 13 are subjected to high stresses during use of the excavation bucket 10 and are particularly liable to suffer fatigue cracking.

Figure 8:
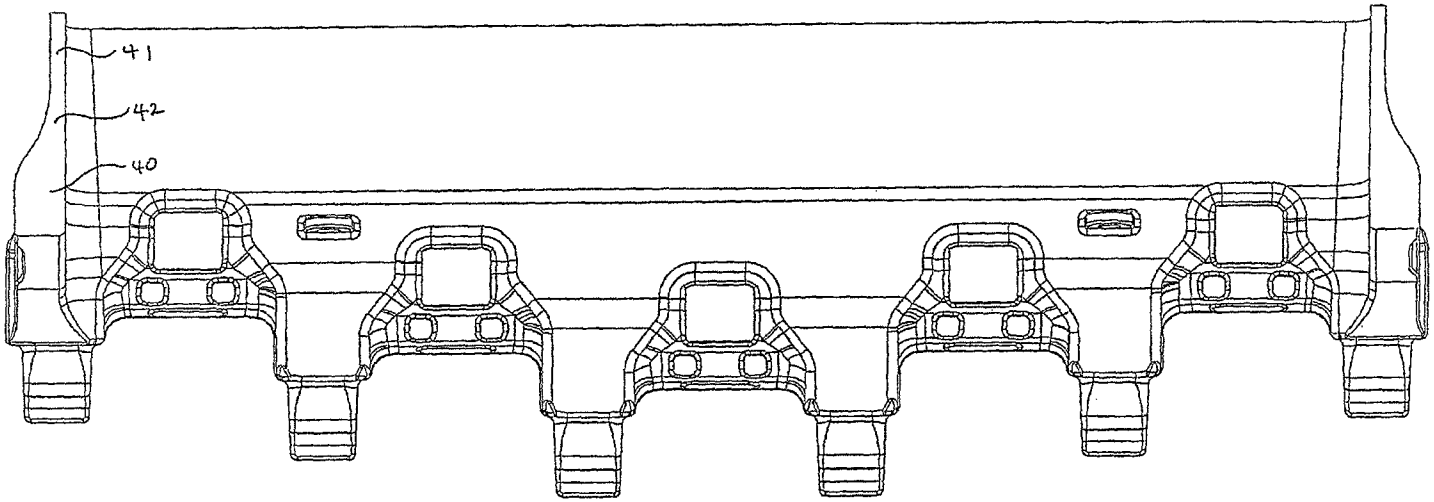
FIGS. 8-10 are top, side and front views of the lip of FIG. 7.
Figure 9:
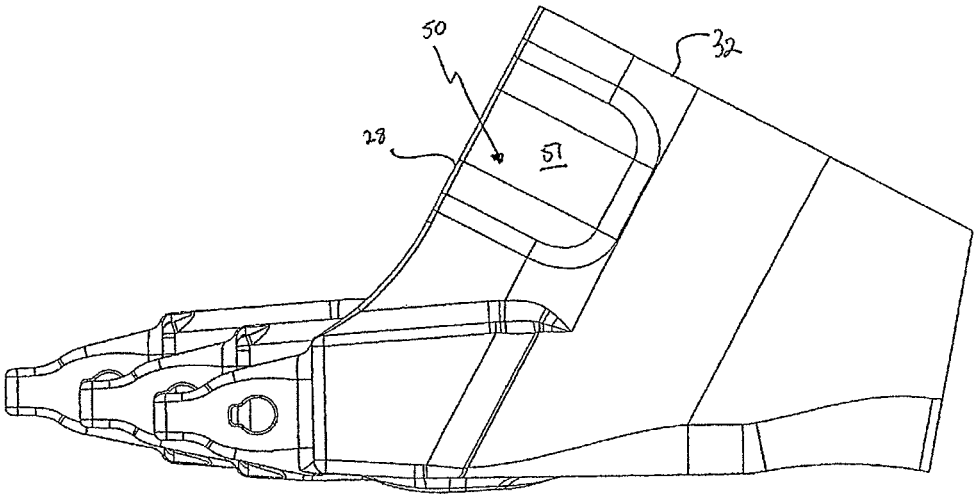
Figure 10:
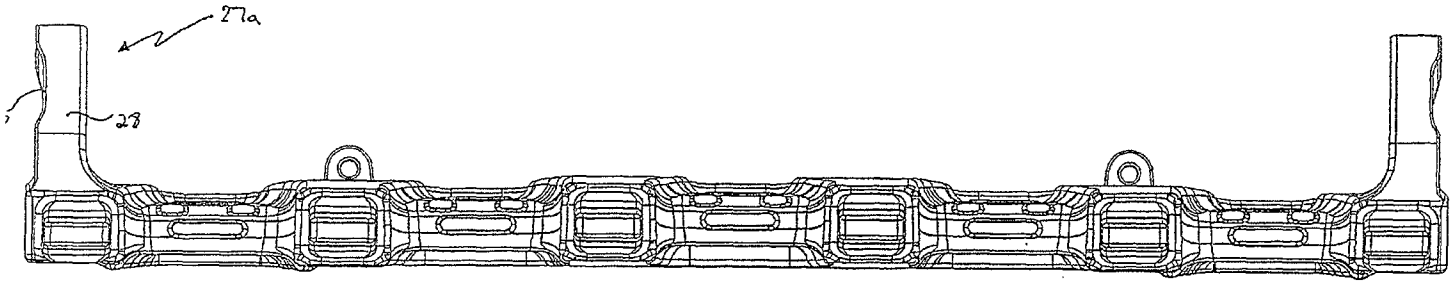
Figure 11:
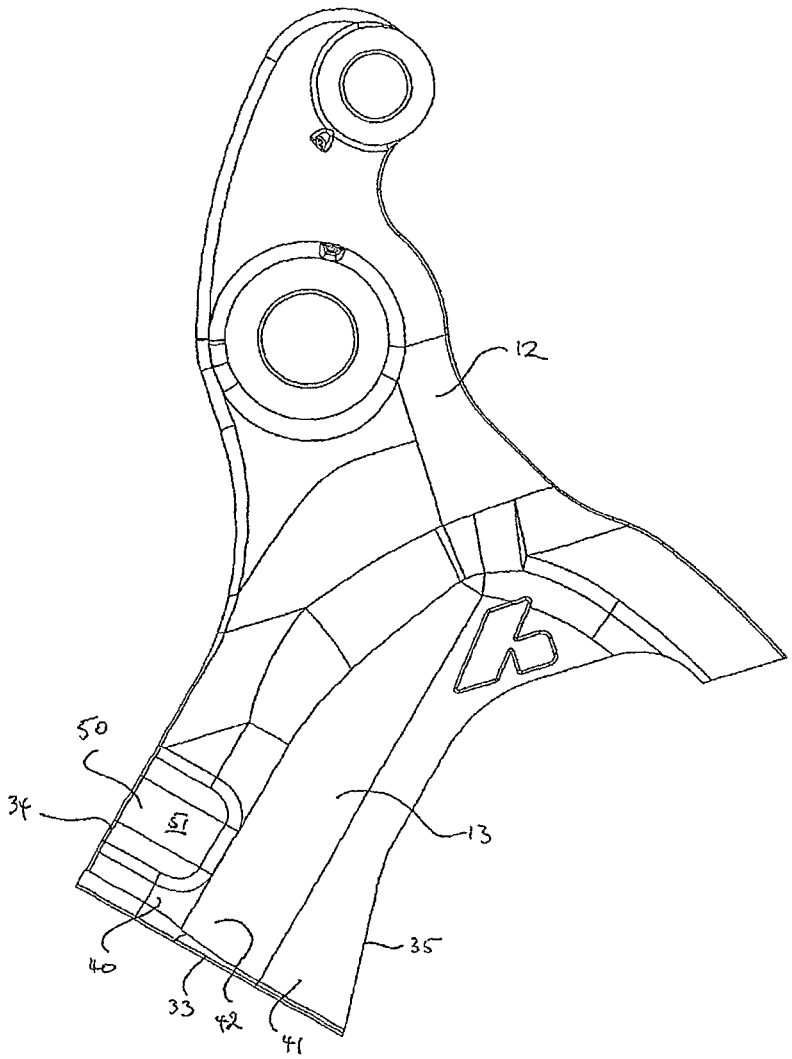
FIG. 11 is a side view of one of the integral neck hinges and cheek members of the excavation bucket of FIG. 1.
Figure 12:
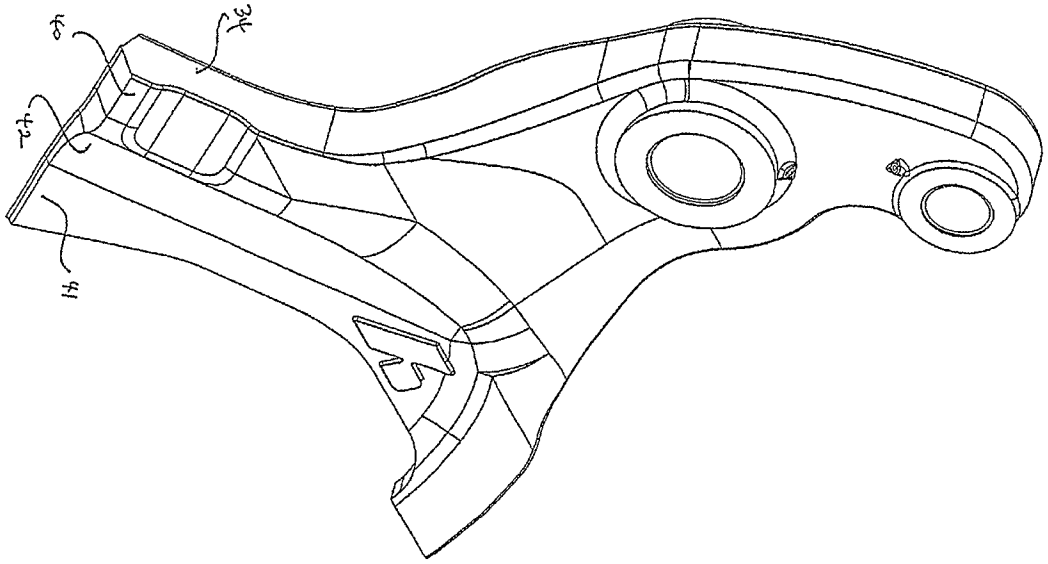
FIGS. 12-14 are perspective, front and below views of the integral neck hinge/cheek member of FIG. 11.
Figure 13:
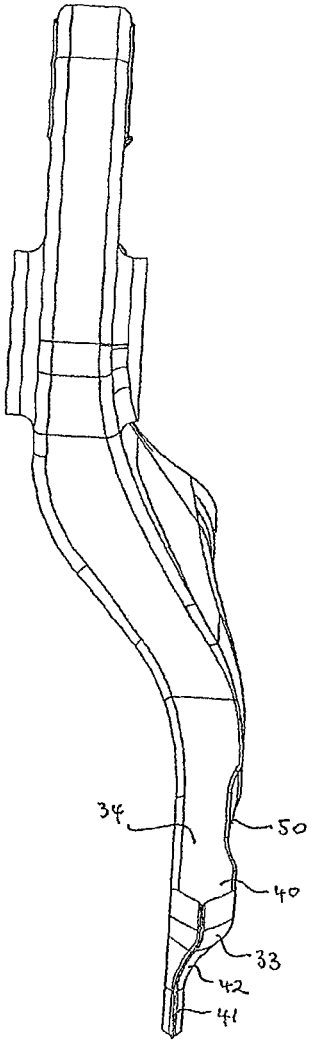
Figure 14:
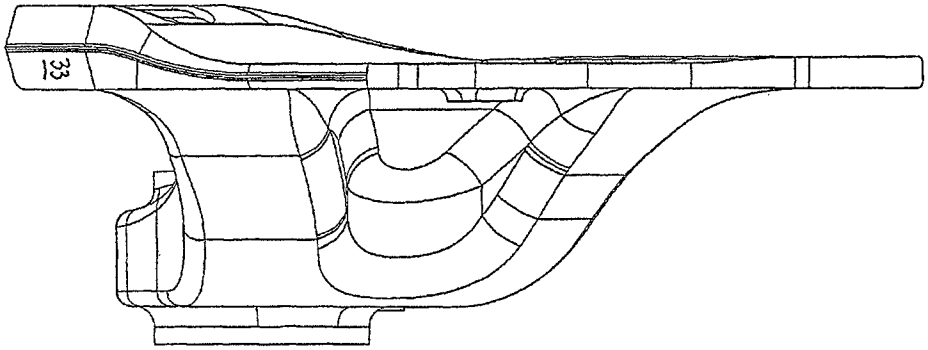

However, in the embodiment shown in the Figures, each of the wing members 27*a, b* and the cheek members 13 are shaped to have a first thicker portion 40 between inner and outer surfaces of respective wing members and cheek members forward of a second thinner portion 41. The first thicker portion 40 of each wing member and cheek member extends rearwardly from the forward edge 28, 34 of that wing member/cheek member. An intermediate portion 42 tapers in thickness from the first portion 41 to the second portion 40 and the second portion then extends from the intermediate portion to the rearward edge of its respective wing member/cheek member. This shaping is shown in detail in FIG. 8. It has been found that the greatest concentration of stress in the joints between respective wing members and cheek members is towards their forward edges. Advantageously, by providing thicker portions in these forward regions the strength of the joint is increased without unnecessarily increasing the weight of the excavation bucket if the whole of the wing members and the cheek members were thickened. Also, the tapered intermediate portions 42 ensure a smooth flow of stress through the wing members and cheek members in use.

The cross-sectional shape of the surfaces of the joint edges 32, 33 of respective wing members 27*a, b* and cheek members 13 are substantially identical so that the inner and outer surfaces of the excavation bucket defined by the wing members and cheek members are generally continuous. It is noted, however, that the joint edge 33 of respective cheek members 13 may be provided with a ridge extending the length of the edge for added strength to the joint.

The wing members 27*a, b* and the cheek members 13 are each provided a recess 50 in their outer surfaces. Each recess 50 extends rearwardly from its respective forward edge 28, 34 of the wing member or cheek member, generally parallel to the other recess on that side of the bucket 10. Accordingly, each recess 50 is formed in the respective thicker portion 40 of that wing member/cheek member. Each recess 50 also extends substantially parallel to the joint edge 32, 33 of the wing member/cheek member in which it is formed, but is spaced from its respective joint edge. The configuration of the recesses 50 also means that there is a recess either side of the joint between respective wing members and cheek members.

Advantageously, the recesses 50 provide weakened regions in the wing members and cheek members that preferentially deform under load so as to relieve loading in the joints between respective wing members and cheek members. That is, when stress is applied to the excavation bucket 10 in use, the recesses 50 can flex, reducing the stresses that are passed through the joints between the wing members and cheek plates. As a result, the likelihood of the joints failing during use is significantly reduced. Although in the particular embodiment shown in the Figures recesses are provided in the lip wing members and the cheek plates, it is to be understood that in other embodiments such recesses could be provided only in the wing members or only in the cheek plates. Furthermore, in other embodiments rather than recesses, other means by which weakened regions are provided in the wing members and/or cheek plates may be incorporated. However, in this respect, a particular further advantage of the recesses 50 is that they are configured to receive part of one of the wear members 29, 36 that are assembled with the excavation bucket 10 to protect the forward edges of the wing members and cheek members from wear. By doing so, the wear members 29, 36 can be formed with a thinner profile so as to reduce their weight. Furthermore, by containing part of the wear members in the recesses, the recesses provide support for the wear members against shear forces during use. This avoids the need to cut and weld shear support plates or blocks for the wear members to the outer surfaces of the bucket, as done conventionally.

The wear members 29, 36 each have an inner surface 60 that engages inner and outer surfaces of the excavation bucket when the wear member is assembled with the bucket and an opposite outer surface 61. The wear members 29, 36 each comprise a wrapping portion 62 that wraps around a respective forward edge 28, 34 of the wing members and/or cheek members 27, 13 when the wear members are assembled with the bucket 10 and a leg 63 extending from the wrapping portion 62. The leg 61 is received in one of the recesses 50 formed in the wing members and/or cheek members. The portion 64 of the inner surface 60 of each wear member defined by its leg 63 bulges so as to be appropriately received in and engage at least part of the floor 51 of one of the recesses 50. An engaging portion in the form of a slot 65 is formed in the leg 63 of each wear member, the slot opening in the inner surface 60 of the wear member and in the distal end 66 of the leg. The slot 65 is shaped to engage a mounting formation in the form of a boss (not shown) that projects from the floor 51 of a respective recess 50. The boss widens as it extends from the floor 51 and does not project beyond the outer surface of the wing member 27*a, b* or cheek member 13 on which it is formed. The slot 65 in the wear member is correspondingly shaped to fit over the boss. A lock 68 is inserted through an opening 69 in the outer surface 61 of the wear member 29, 36 to retain that wear member in its assembled condition with the excavation bucket 10.

The wrapping portions 62 of the wear members 29, 36 are wider than their respective legs 63. Advantageously, the wrapping portion 62 of one of the wear members (in the embodiment shown in the Figures it is the wear members 36 mounted to respective cheek members 13, although in other embodiments it could be the wear member 29 mounted to respective wing members 27) extends over the joint between the wing member and the cheek member on each side of the excavation bucket at their forward edges. This helps protect the joint from wear during use and thus reduces the likelihood that the joint will fail.

In the claims which follow and in the preceding summary of the invention except where the context requires otherwise due to express language or necessary implication, the word "comprising" is used in the sense of "including", that is, the features as above may be associated with further features in various embodiments of the invention.

Variations and modifications may be made to the parts previously described without departing from the spirit or ambit of the disclosure. For example the number and arrangement of the positioning and spacing of the ribs and supports may vary. Also in alternate forms, the ribs may be integrated into the side walls such as for example made integrally with the sheet by profiling of the sheets or by forming an integrated strengthening formation at a join between adjacent sheet panels forming the sheet.

Accordingly, the present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods which can, of course, vary. It is also to be understood that the terminology used herein is for the purpose of describing particular embodiments only, and is not intended to be limiting.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. A member of an excavation bucket for assembly with at least one other bucket member in an assembled condition to form the bucket, wherein the member is a side wall portion of the excavation bucket when in its assembled condition, the member comprising:

a body having opposite inner and outer surfaces that respectively define at least portions of inner and outer surfaces of the bucket when the member is in its assembled condition;

a joint edge that in use joins to a corresponding joint edge of another bucket member to form a joint in the excavator bucket; and a weakened region that is arranged to preferentially deform under load so as to relieve loading in the excavator bucket joint, wherein the weakened region comprises a recess formed in the inner and/or outer surface of the member's body, wherein the body of the member has a forward edge and a rearward edge, the recess extending rearwardly from the forward edge.

2. The member of claim 1, wherein the weakened region is spaced from the joint edge of the member.

3. The member of claim 1, wherein the body has a first portion that is thicker between its inner and outer surfaces than a second portion and the weakened region is formed in the first portion.

4. The member of claim 1, wherein the member also comprises a mounting formation for a wear member to be mounted to, wherein the wear member in use protects the member against wear, and wherein the mounting formation located at the weakened region.

5. The member of claim 1, wherein the weakened region is elongated in a direction substantially parallel to the joint edge of the member.

6. The member of claim 1, wherein the member is a wing member of a lip for the excavation bucket, the lip comprising a base portion that forms part of the digging edge of the bucket when the lip is in an assembled condition with other members to form the bucket and wherein the wing member extends from the base portion at a side of the base portion.

7. An excavation bucket assembly incorporating first and second members that are interconnected by a joint in an assembled condition, wherein the first and second members are side wall portions of the excavation bucket when in their assembled condition, wherein at least one of the first and second members comprises a weakened region that is arranged to preferentially deflect under load to relieve loading in the joint and wherein each weakened region comprises a recess formed in an inner and/or outer surface of the respective member's body, and wherein the body of the member has a forward edge and a rearward edge, the recess extending rearwardly from the forward edge.

8. The excavation bucket assembly of claim 7, wherein each of the first and second members comprise said weakened region and wherein the weakened regions are disposed on either side of the joint.

9. The excavation bucket assembly of claim 7, wherein the first member is a wing member of a lip for the excavation bucket, the lip comprising a base portion that forms part of the digging edge of the bucket when the lip is in the assembled condition and wherein the wing member extends from the base portion at a side of the base portion.

10. The excavation bucket assembly of claim 7, wherein the second member is a side wall member that forms at least part of the side wall of the bucket when in its assembled condition.

11. A member of an excavation bucket for assembly with at least one other bucket member in an assembled condition to form the bucket, wherein the member is a side wall portion of the excavation bucket when in its assembled condition, the member comprising:

a body having opposite inner and outer surfaces that respectively define at least portions of inner and outer surfaces of the bucket when the member is in its assembled condition;

a joint edge that in use joins to a corresponding joint edge of another bucket member to form a joint in the excavator bucket;

a weakened region that is arranged to preferentially deform under load so as to relieve loading in the excavator bucket joint, the weakened region comprises a recess formed in the inner and/or outer surface of the member's body; and the body of the member has a forward edge and a rearward edge, the recess extending rearwardly from the forward edge, and the body has a first portion and a second portion, and the weakened region is formed in the first portion, wherein the recess of the weakened region includes a floor, and the floor is continuous with a surface of the second portion.

12. A member according to claim 11, wherein the first portion is thicker between its inner and outer surfaces than the second portion.

13. A member according to claim 12, wherein the body of the member also has an intermediate portion that tapers between the inner and outer surfaces of the body from the first portion to the second portion.

14. A member according to claim 13, wherein the second portion extends from the intermediate portion to the rearward edge of the body.

15. A member according to claim 14, wherein the first portion extends from the intermediate portion to the forward edge of the body.

* * * * *